US006162106A

United States Patent [19]

Shieh

[11] Patent Number: 6,162,106

[45] Date of Patent: Dec. 19, 2000

[54] INFLATABLE FLAG BUOY WORKABLE IN BOTH THE DAYTIME AND THE NIGHT

[76] Inventor: Steve S. Shieh, No. 480, Chung Shan North Road, Section 5, Taipei, Taiwan

[21] Appl. No.: 09/302,449

[22] Filed: Apr. 30, 1999

[51] Int. Cl.[7] ..... B63B 22/22; B63B 22/00; B63C 11/46

[52] U.S. Cl. ..... 441/30; 441/13; 114/315

[58] Field of Search ..... 441/1, 6, 11, 13, 441/16, 28, 29, 30, 40, 136; 114/315, 264

[56] References Cited

U.S. PATENT DOCUMENTS 4,571,194 2/1986 Kiss et al. ..... 441/1
4,662,301 5/1987 Wolfe ..... 114/264

*Primary Examiner*—S. Joseph Morano
*Assistant Examiner*—Patrick Craig Muldoon
*Attorney, Agent, or Firm*—Dougherty & Troxell

[57] ABSTRACT

An inflatable flag buoy for divers including a buoyant seat and a flag body in the form of two air chambers separated by a transparent interface. The buoyant seat is further divided into an upper air chamber and a lower water chamber that are not communicable with one another. Water filled in the water chamber always keeps the whole flag buoy in an upright position while air filled in the air chamber always keeps the flag buoy afloat on a water surface. A flashlight may be held in a space below said transparent interface and surrounded by said buoyant seat. The flag body includes communicable post portion and flag portion that is centered at a top of the post portion. Light given out by the flashlight passes through the transparent interface and the post portion to project onto and lighten the flag portion to produce good warning effect in the night. Pockets and recesses are provided on the post portion and the buoyant seat for conveniently holding miscellaneous articles, beverage bottles, etc.

6 Claims, 4 Drawing Sheets

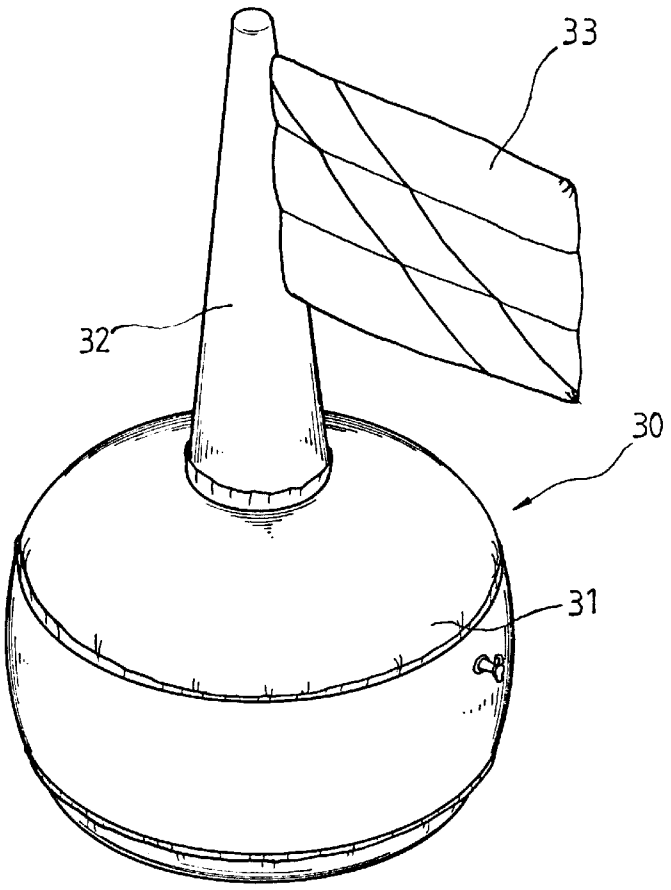
PRIOR ART-FIG.3
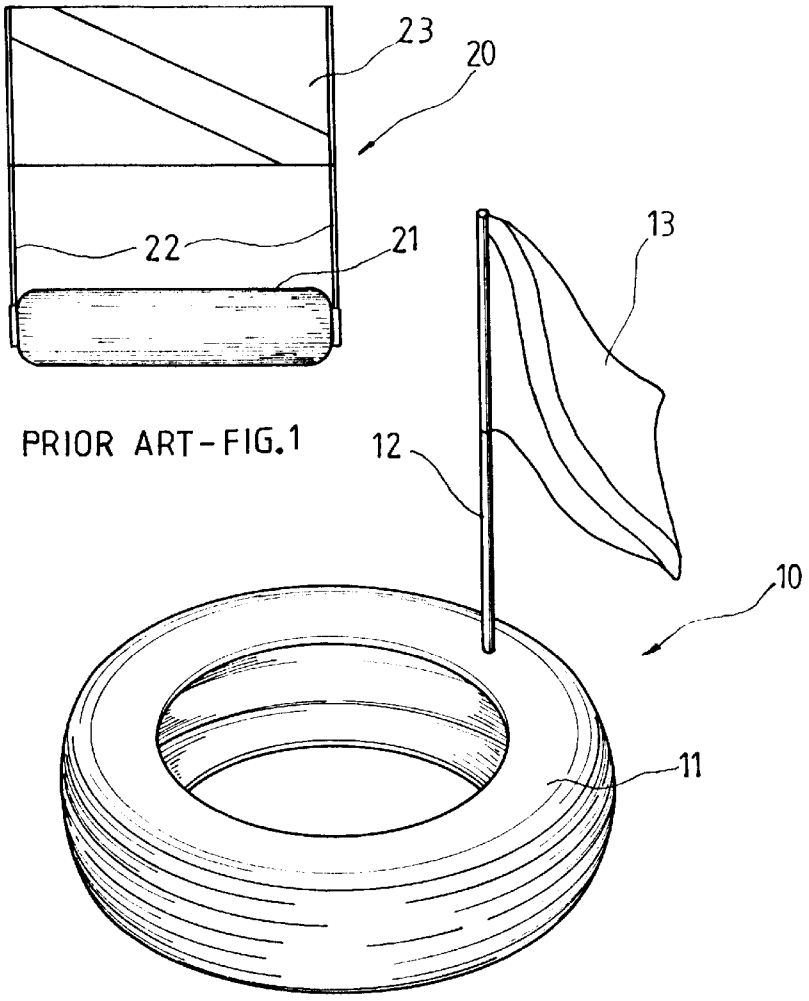
PRIOR ART-FIG.1
PRIOR ART-FIG.2

INFLATABLE FLAG BUOY WORKABLE IN BOTH THE DAYTIME AND THE NIGHT

BACKGROUND OF THE INVENTION

The present invention relates to a flag buoy, and more particularly to an inflatable flag buoy having separated buoyant seat and flag body in the form of air chambers and a flashlight holder for holding a flashlight to lighten the flag body for good warning effect in both the daytime and the night.

Diving is one of the most popular water sports and generally includes snorkeling, skin diving, and scuba diving. To protect divers from being accidentally hurt under water by, for example, passing vessels and the like, a flag buoy is usually positioned on a water surface under which divers are working or moving around. The flag buoy has a flag showing a diagonally extended straight strip that has become an internationally recognized symbol indicating the presence of divers working under water around the flag buoy. Any vessel shall bypass a water area within 30 meters from the flag buoy. Therefore, the flag buoy is indeed very important to the safety of divers. However, most of the flag buoys are so simple in structure that they fail to provide complete warning effect, particularly when the flag buoys are used in the night.

FIG. 1 shows a conventional flag buoy 10 in the simplest form. The flag buoy 10 includes a waste tire and the like to serve as a buoyant seat 11, a pole 12 fitted on the tire 10, and a flag 13 printed with a diagonally extended straight strip and hung on the pole 12. The flag 13 is naturally drooping when it is windless. The waste tire 11 is heavy and bulky and cannot be conveniently carried. And, the whole flag buoy 10 is useless when it is used in the night.

FIG. 2 shows another conventional flag buoy 20 that includes a buoyant seat 21 similar to the buoyant seat 11 in the first conventional flag buoy 10, and two spaced poles 22 with a flag 23 stretched between them. The flag buoy 20 has the same disadvantages as that of the first flag buoy 10, namely, inconvenient for carrying and too simply to provide any other functions.

FIG. 3 shows a further conventional flag buoy 30 that includes an integral inflatable air chamber generally divided into a seat portion 31, a pole portion 32, and a flag portion 33. An advantage of the flag buoy 30 is it can be conveniently carried in a deflated state. However, the inflatable flag buoy 30 also provides only one single function as a flag buoy and is useless in the night. Moreover, any leak on any portion of the inflatable flag buoy 30 shall cause the whole flag buoy 30 to completely lose its function. The inflatable flag buoy 30 therefore has low reliability and safety for use. A further disadvantage of the flag buoy 30 is that the flag portion 33 is always located at one side of the pole portion 32 and therefore prevents the whole flag buoy 30 from standing upright in a balanced state. The bigger the flag portion 33 is, the more the whole flag buoy 30 would incline.

It is therefore desirable to develop a flag buoy that would eliminate the disadvantages existing in the various types of conventional flag buoys and provides more functions other than a flag buoy.

SUMMARY OF THE INVENTION

A primary object of the present invention is to provide a flag buoy that includes a buoyant seat and a flag body in the form of two separated air chambers and therefore provides higher safety and reliability in use.

Another object of the present invention is to provide an inflatable flag buoy having a buoyant seat and a flag body separated by an interface made of a transparent material, and a flashlight holder provided in a space surrounded by the buoyant seat and below the flag body for holding a flashlight. The flashlight gives out light that passes through the transparent interface to lighten the flag body in the night.

A further object of the present invention is to provide an inflatable flag buoy having a buoyant seat and a flag body in the form of two separated air chambers, and the flag body including a post portion and a flag portion centered at a top of the post portion, so that the whole flag buoy always floats in an upright and balanced position.

A still further object of the present invention is to provide an inflatable flag buoy having a buoyant seat and a flag body in the form of two separated air chambers, and the air chambers having pockets provided thereat for holding things like beverage cans, flasher, etc., so that the flag buoy may also serve as a temporary rest station for divers.

BRIEF DESCRIPTION OF THE DRAWINGS

FIG. 1 is a perspective of a conventional flag buoy;

FIG. 2 is a front elevation of another conventional flag buoy;

FIG. 3 is a perspective of a further conventional flag buoy;

DETAILED DESCRIPTION OF THE PREFERRED EMBODIMENTS

Figure 4:
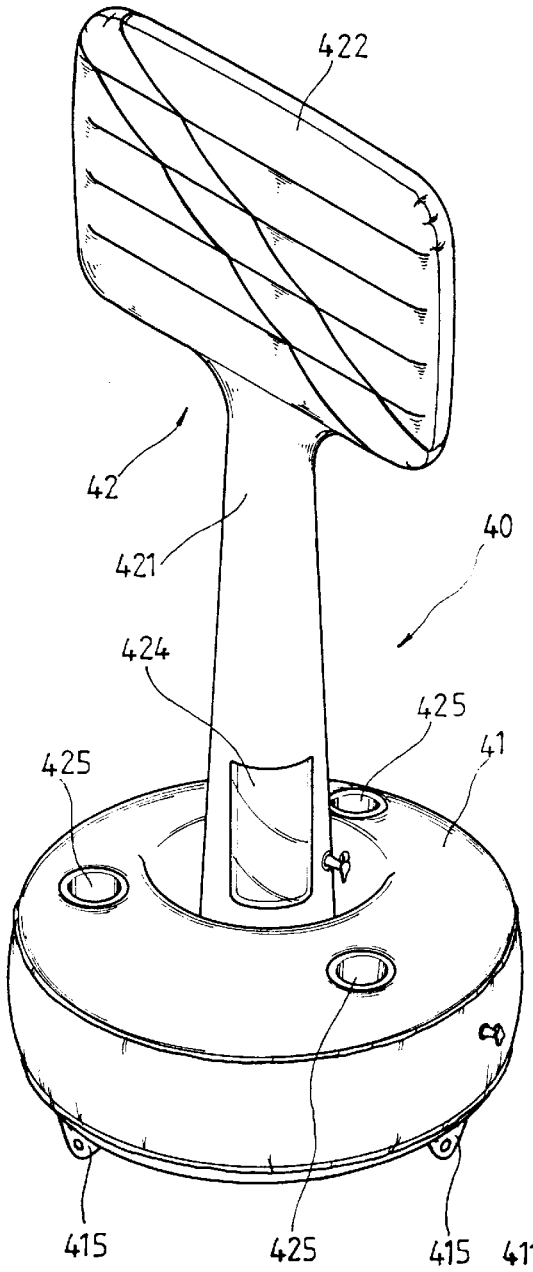
FIG. 4 is a perspective of a flag buoy according to the present invention.
Figure 5:
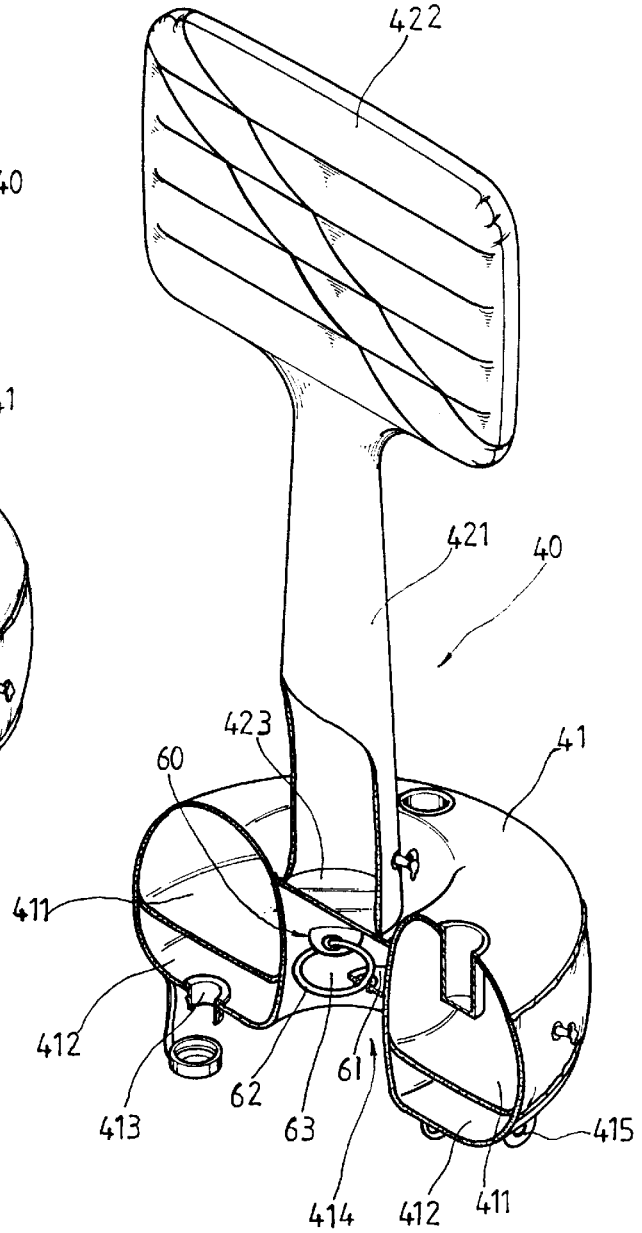
FIG. 5 is a perspective similar to FIG. 4 but with a part thereof cut away to show an internal structure thereof.
Figure 6:
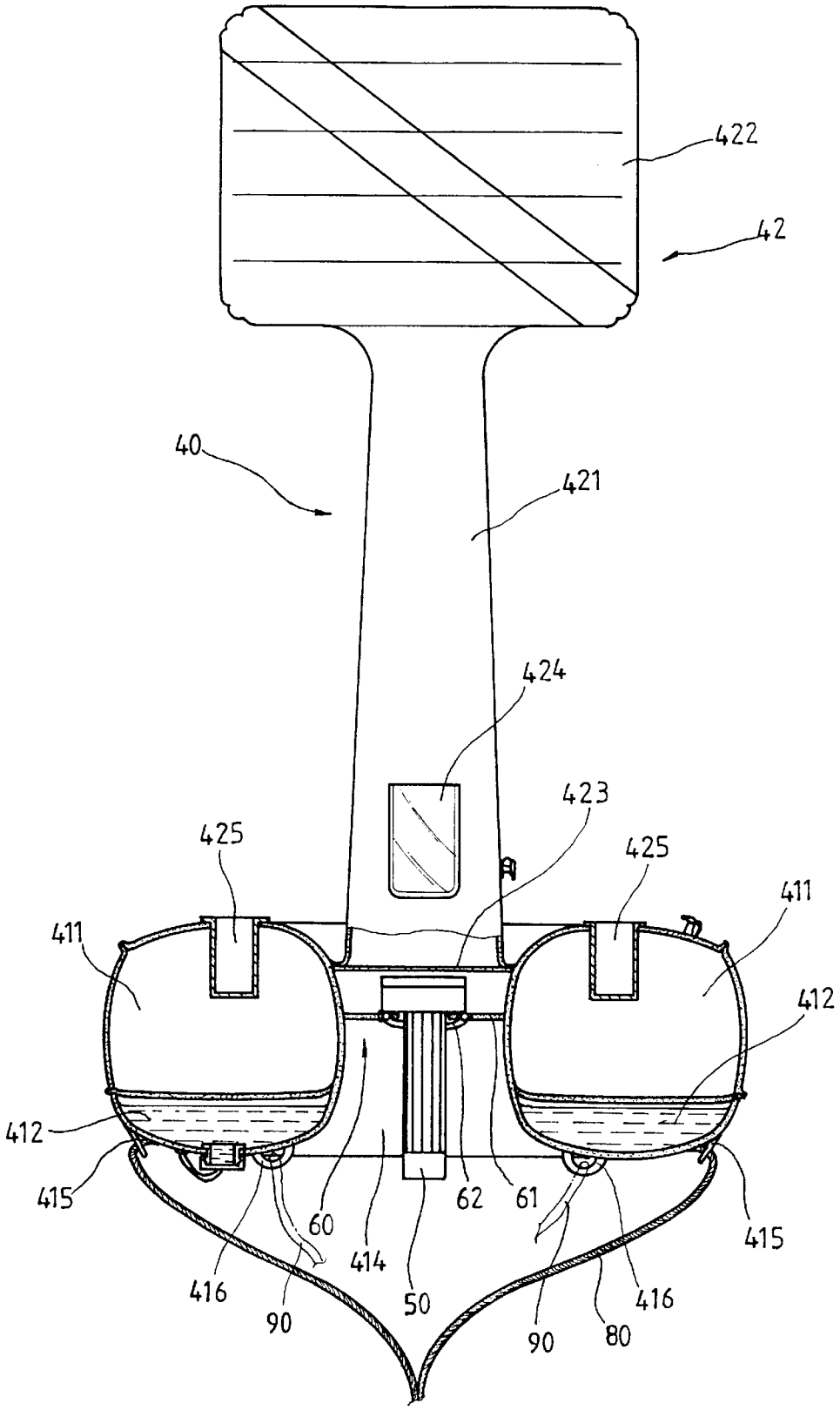
FIG. 6 is a vertical sectional view of the flag buoy of FIG. 4.

Please refer to FIGS. 4, 5, and 6 at the same time. A flag buoy 40 according to the present invention is shown in the drawings. As shown, the flag buoy 40 is a one-piece inflatable buoy but includes a buoyant seat 41 and a flag body 42 in the form of two separated air chambers. The flag body 42 includes a post portion 421 and a flag portion 422 located on a top of and communicable with the post portion 421. In the event one of the two separated air chambers 41 and 42 has any leak, the other air chamber will still keep the whole flag buoy 40 afloat. The flag buoy 40 is therefore safer and more reliable for use.

The flag body 42 is located at and connected to a top center of the buoyant seat 41 by means of heating seal. A bottom 423 of the flag body 42 is made of a transparent material and forms an interface between the buoyant seat 41 and the flag body 42 to separate them from one another.

The buoyant seat 41 is in a shape of a life buoy and defines an annular inner space. The annular inner space is divided into an upper air chamber 411 and a lower water chamber 412 that are not communicable with one another. The upper air chamber 411 is filled with air to work with the flag body 42 to keep the flag buoy 40 afloat. On the other hand, the lower water chamber 412 has a valve cap 413 via which an adequate amount of water is filled into the lower water chamber 412 to produce a vertical downward force in the flag buoy 40. The upward buoyancy produced by the air in the upper air chamber 411 and the flag body 42 and the downward force produced by the water in the lower water chamber 412 together produce a torque that enables the flag buoy 40 in a tilted position to automatically return to an upright position. The flag body42 of the flag buoy 40 in an upright position can therefore provide the best warning effect.

The annular buoyant seat 41 and the transparent interface 423 together define a downward opened space 414. A plurality of lug pieces 61 are spaced along an inner periphery of the buoyant seat 41 at an adequate height to project toward the space 414. Each of the lug pieces 61 has an eyelet for an elastic cord 62 to extend therethrough to form a loop 63 having a diameter smaller than that of an expanded head portion of a common flashlight 50. The elasticity of the cord 62 allows the loop 63 to expand and tightly bind the flashlight 50, so that the flashlight 50 is held in the loop 63 in the space 414. The lug pieces 61 and the loop 63 formed from the elastic cord 62 therefore together provide a simple flashlight holder 60 on the flag buoy 40.

Figure 7:
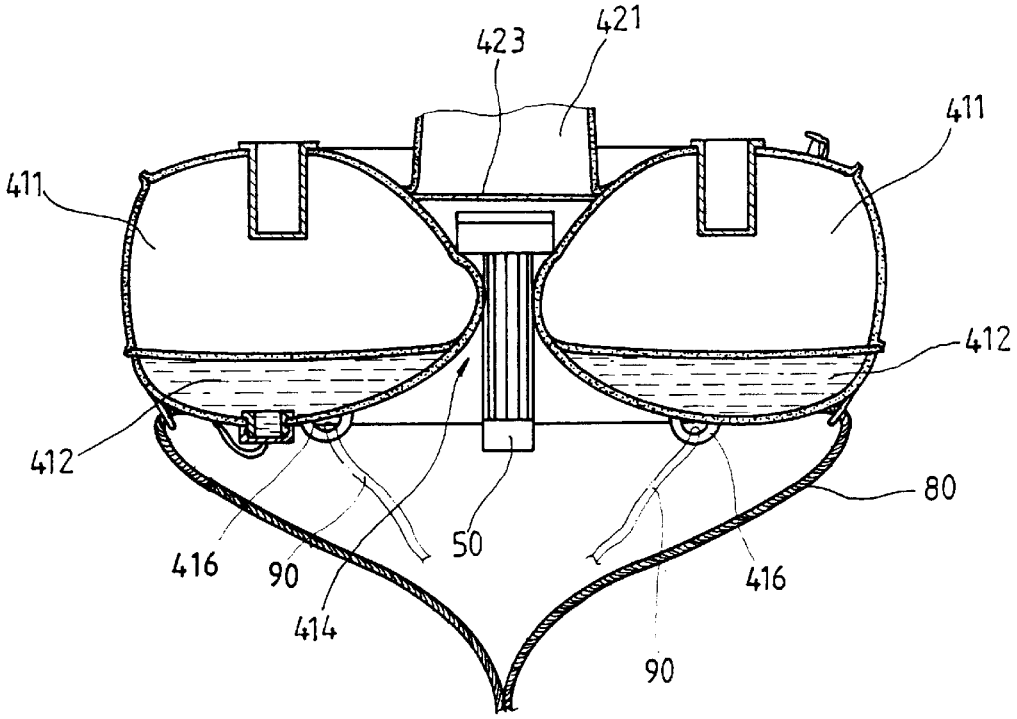
FIG. 7 is a fragmentary sectional view of the flag buoy of FIG. 4 showing another embodiment of the flashlight holder of the present invention.

The flag buoy 40 shown in FIG. 7 has a buoyant seat 41 that has an inner periphery extended and projected into the space 414, such that the space 414 has a narrowed middle portion and widened top and bottom portions. Thereby, the flashlight 50 may be easily inserted through the narrowed middle portion of the space 414 and clamped by the inward projected inner periphery of the buoyant seat 41. The inward projected inner periphery of the buoyant seat 41 therefore forms another embodiment of the flashlight holder on the flag buoy 40 of the present invention. Since the flashlight holder in this embodiment is formed when forming the buoyant seat 41, it is obviously a most convenient and practical way for holding a flashlight 50.

Figure 8:
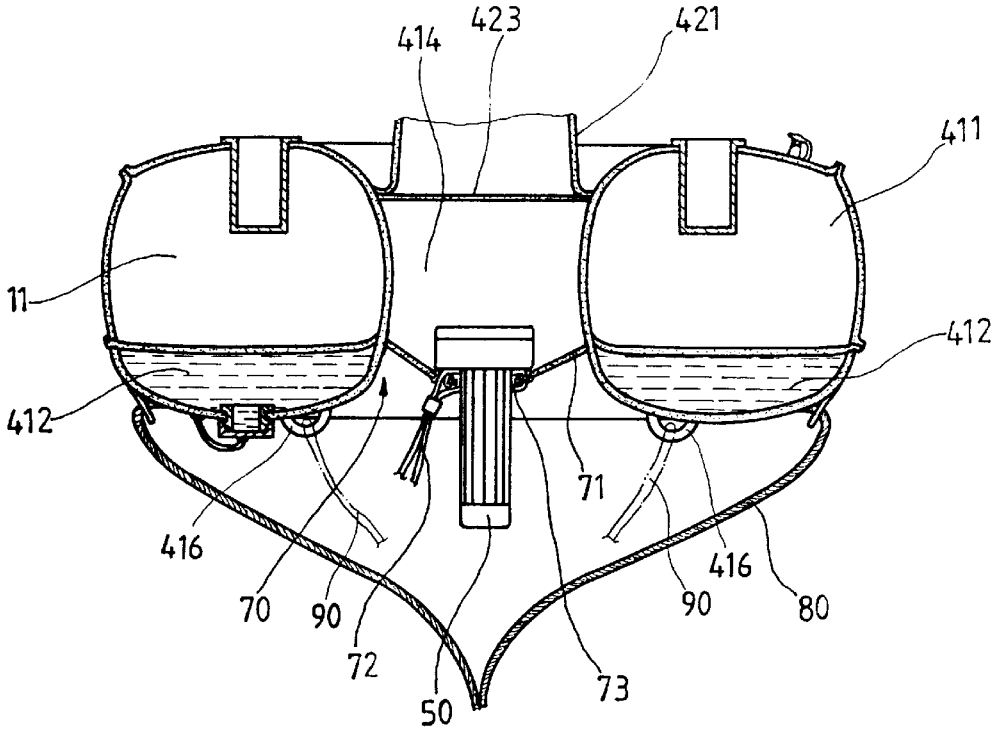
FIG. 8 is also a fragmentary sectional view of the flag buoy of FIG. 4 showing a further embodiment of the flashlight holder of the present invention.

FIG. 8 illustrates a flag buoy 40 having a still differently structured flashlight holder 70. The flashlight holder 70 includes a plurality of lug pieces 71 spaced along the inner periphery of the buoyant seat 41 at a lower portion thereof, and a common cord 72 threaded through eyelets 73 on the lug pieces 71 to form a loop. By tightening or loosening the cord 72, the flashlight 50 may be held in or removed from the loop formed by the cord 72.

It is understood that it is not technically difficult to provide a flashlight holder in the space 414 and therefore there are many other similar means to provide equivalent function as that of the flashlight holders described herein. All these similar means for holding a flashlight 50 below the flag body 42 of the flag buoy 40 should be included in the scope of the present invention.

The flashlight 50 is held by the flashlight holders with its head pressing against the transparent interface 423, so that light given out by the flashlight 50 passes through the transparent interface 423 and the post portion 421 to project onto the flag portion 422 of the flag body 42. By making the flag body 42 with a light-transmissible material, the flag body 42 lightened by the flashlight 50 shall provide good warning effect in the night.

A plurality of lug pieces 415 are spaced along a bottom surface of the buoyant seat 41. And, it would be most preferable to have 4 of such lug pieces 415. Each of the lug pieces 415 has an eyelet for a cord 80 to extend therethrough. A diver may grip at the cord 80 when necessary. Moreover, a plurality of ears 416 are also provided at the bottom surface of the buoyant seat 41. A cord 90 may be threaded through the ears 416 and be used as an anchor cord or a decompression cord.

One of the advantages of the flag buoy 40 of the present invention is it has a flag portion 422 centered at a top of the post portion 421, instead of locating at one lateral side of the post portion 421. This design allows the whole flag buoy 40 to always in a balanced position. Another important advantage of the flag buoy 40 is it has a transparent interface 423 between the flag body air chamber 42 and the buoyant seat air chamber 41, allowing light given out by the flashlight 50 to directly project onto the flag portion through the interface 423 and the post portion 421 and therefore brightly lightens the flag portion 422.

The flag buoy 40 of the present invention may be provided with additional structures so as to provide more functions.

Such additional structures include:

1. Pockets 424 made of transparent material attached to outer surface of the post portion 421 for holding spare parts or any other necessary things, such as notebook, flasher (not shown), etc. The flasher positioned in the pocket 424 may also work as an auxiliary means to give out warning flashes.

2. Recesses 425 formed along an upper surface of the buoyant seat 41 for holding beverage cans or bottles, allowing the flag buoy 40 to be used as a temporary rest station for divers.

With the above arrangements, the flag buoy of the present invention has improved structure and accordingly enhanced safety and reliability in use. Moreover, the flag buoy of the present invention provides additional functions and is therefore more practical for use.

What is claimed is:

1. An inflatable flag buoy workable in both the daytime and the night, comprising a buoyant seat and a flag body in the form of two air chambers separated by an interface;

said buoyant seat defining an annular inner space that is divided into an upper air chamber and a lower water chamber that are not communicable with one another; said upper air chamber being filled with air to produce a buoyancy for keeping said flag buoy afloat, and said lower water chamber being filled with adequate amount of water to produce a vertical downward force for always keeping said flag buoy in an upright position; said buoyant seat together with said interface defining a downward opened space below said flag body, means being provided on portions of said buoyant seat surrounding said downward opened space to form a flashlight holder for holding a flashlight thereto, such that light given out by said flashlight projects upward through said interface to lighten said flag body, permitting said flag buoy to serve as a significant warning sign in the night; and said flag body being centered at and connected to a top of said buoyant seat, and including a post portion and a flag portion that are two air chambers communicable with one another, said flag portion being located on a top of said post portion, and said post portion having a bottom surface that is also said interface located between said flag body and said buoyant seat to separate them from one another.

2. An inflatable flag buoy as claimed in claim 1, wherein said means forming said flashlight holder include a plurality of spaced lug pieces provided along an inner periphery of said buoyant seat surrounding said downward opened space and an elastic cord, said elastic cord being threaded through eyelets provided on said lug pieces to form an elastic loop, whereby said flashlight may be tightly bound by said elastic loop at an expanded head portion of said flashlight.

3. An inflatable flag buoy as claimed in claim 1, wherein said means forming said flashlight holder include portions on an inner periphery of said buoyant seat that extend and project inward toward said downward opened space to make said space have a narrowed middle portion and widened top and bottom portions, whereby said flashlight may be inserted into said narrowed middle portion of said downward opened space and clamped by said inward projected inner periphery of said buoyant seat.

4. An inflatable flag buoy as claimed in claim 1, wherein said flag portion of said flag body is preferably centered at the top of said post portion, such that the light given out by said flashlight is allowed to pass through said post portion to directly project onto said flag portion to lighten the same for best warning effect.

5. An inflatable flag buoy as claimed in claim 1, wherein said post portion of said flag body is provided on an outer surface with one or more pockets made of transparent material for holding spare parts and/or other necessary things for divers.

6. An inflatable flag buoy as claimed in claim 1, wherein said upper air chamber of said buoyant seat is provided at a top surface with a plurality of recesses for holding beverage cans and/or bottles, etc.

* * * * *